US008480436B2

(12) United States Patent
Chang

(10) Patent No.: US 8,480,436 B2
(45) Date of Patent: Jul. 9, 2013

(54) USB CONNECTOR STRUCTURE HAVING AN INSULATING BODY WITH A STOP PLATE WITH OPENINGS

(76) Inventor: Nai-Chien Chang, New Taipei (TW)

( * ) Notice: Subject to any disclaimer, the term of this patent is extended or adjusted under 35 U.S.C. 154(b) by 0 days.

(21) Appl. No.: 13/422,595

(22) Filed: Mar. 16, 2012

(65) Prior Publication Data

US 2012/0252278 A1 Oct. 4, 2012

(30) Foreign Application Priority Data

Mar. 28, 2011 (TW) ..... 100205464 U

(51) Int. Cl.
*H01R 13/00* (2006.01)

(52) U.S. Cl.
USPC ..... 439/660

(58) Field of Classification Search
USPC ..... 439/660, 607.01, 607.31, 620.15
See application file for complete search history.

(56) References Cited

U.S. PATENT DOCUMENTS 7,090,541 B1 * 8/2006 Ho ..... 439/660
7,165,998 B2 * 1/2007 Lee et al. ..... 439/660
7,223,127 B2 * 5/2007 Ho ..... 439/660
7,927,145 B1 * 4/2011 Chang ..... 439/607.31
8,102,657 B2 * 1/2012 Hiew et al. ..... 361/737
8,408,940 B2 * 4/2013 Chang ..... 439/607.01
8,414,331 B2 * 4/2013 Chang ..... 439/607.01
2012/0252273 A1 * 10/2012 Chang ..... 439/620.15

* cited by examiner

*Primary Examiner* — Chandrika Prasad
(74) *Attorney, Agent, or Firm* — Chun-Ming Shih; HDLS IPR Services

(57) ABSTRACT

A USB connector structure includes an insulating body, a circuit board, a plurality of connecting terminals and a plurality of conductive terminals. The insulating body includes a through notch, a plurality of terminal slots formed at a lower edge of the through notch, and a stop plate extended forwardly from the terminal slots which forms a plurality of first openings and second openings thereon; the circuit board having a plurality of goldfingers being passed and coupled to the through notch, and the position of each goldfinger is aligned with the first opening; the connecting terminals passed to the circuit board and situated away from the goldfinger and electrically coupled to each goldfinger; each conductive terminal passed into the terminal slot and having a conducting portion at a front end which is aligned with the second opening, so as to prevent the conductive terminals from being shifted or deviated.

10 Claims, 4 Drawing Sheets

USB CONNECTOR STRUCTURE HAVING AN INSULATING BODY WITH A STOP PLATE WITH OPENINGS

FIELD OF THE INVENTION

The present invention relates to an improved connector structure, in particular to an improved USB connector structure.

BACKGROUND OF THE INVENTION

At present, universal serial bus (USB) is the most popular transmission interface for computer peripherals and was developed and promoted by Intel and Microsoft and gone through the development process of three versions, respectively: USB 1.0, USB 1.1 and USB 2.0. The standards of USB 1.0, 1.1 and 2.0 support the following three transmission rates: (1) a low-speed transmission rate of 1.5 Mbps; (2) a full-speed transmission rate of 12 Mbps; and (3) a high-speed transmission rate of 480 Mbps.

As the electronic industry advances, even the transmission rate of the USB 2.0 can no longer meets the industrial and user requirements, so that the other USB 3.0 standard is introduced. In the USB 3.0 standard, two sets of differential terminals and a grounding terminal are added to the USB 2.0 having four terminals, so that the USB 3.0 standard has a total of nine terminals, and the transmission rate can reach up to the level of 5 Gbps.

Based on the prior art, a female connector in compliance with the USB 3.0 standard comprises an insulating body, a tongue plate extended from a front end of the insulating body for installing a contact portion of the five added terminals and a contact portion of the original four terminals of the USB 2.0 standard on opposite surfaces of the tongue plate respectively. Since the positions of these terminals are standardized, therefore the five added terminals and the original four terminals can be arranged in two rows in the vertical direction, and all terminals are separated from each other to avoid short circuits.

However, computer peripherals and their corresponding connectors tend to be developed with an increasingly thinner, lighter, shorter and smaller design, so that the level of difficulty for installing the nine terminals on the small-size tongue plate is increased significantly and the total volume of the connector cannot be decreased further.

It is a subject for related manufacturers to overcome the aforementioned problems, so that the inventor of the present invention conducted extensive researches and experiments, and finally provided a feasible design to overcome the problems.

SUMMARY OF THE INVENTION

Therefore, it is a primary objective of the present invention to provide an improved USB connector structure capable of simplifying the structure and reducing the volume of the connector to meet the thin design requirement, while preventing the deviation or deformation of the conductive terminals caused by the simplified structure after a long time of use.

To achieve the aforementioned objective, the present invention provides an improved USB connector structure comprising an insulating body, a circuit board, a plurality of connecting terminals and a plurality of conductive terminals, wherein the insulating body includes a through notch formed therein and a plurality of terminal slots formed at a lower edge of the through notch, a stop plate extended forwardly from the plurality of terminal slots, and a plurality of first openings and a plurality of second openings formed on the stop plate; the circuit board includes a plurality of goldfingers installed at an end of the circuit board and passed into and coupled to the through notch, and the position of each goldfinger is aligned with the first opening; the connecting terminal has an end passed into the circuit board and disposed at an end away from the goldfinger and electrically coupled to each goldfinger; each conductive terminal has a conducting portion disposed at a front end of the conductive terminal, and is passed and coupled into the terminal slot, and the position of each conducting portion is aligned with the second opening.

Compared with the prior art, the present invention has the following effects. Since the present invention has the plurality of goldfingers installed at the front end of the circuit board directly and the plurality of connecting terminals disposed at the rear end of the circuit board and electrically coupled to the goldfingers to substitute the conventional five conductive terminals, therefore it is not necessary to extend the insulating body from the tongue plate to connect the nine conductive terminals, so as to simplify the structure of the female connector and comply with the thin design requirement. On the other hand, the simplified structure of the present invention reduces the number of required components, and thus reducing the manufacturing cost and time.

In addition, a stop plate installed on the insulating body and extended forwardly from the plurality of terminal slots, so that when each conductive terminal is passed and coupled into the terminal slot, each conducting portion can be protruded out from the second opening formed on the stop plate, so as to fix each conductive terminal. The present invention can prevent each conductive terminal from being deviated or deformed easily after a long time of use, so as to extend the service life of the connector effectively.

DESCRIPTION OF THE PREFERRED EMBODIMENTS

The technical characteristics and contents of the present invention will become apparent with the following detailed description and related drawings. The drawings are provided for the purpose of illustrating the present invention only, but not intended for limiting the scope of the invention.

Figure 5:
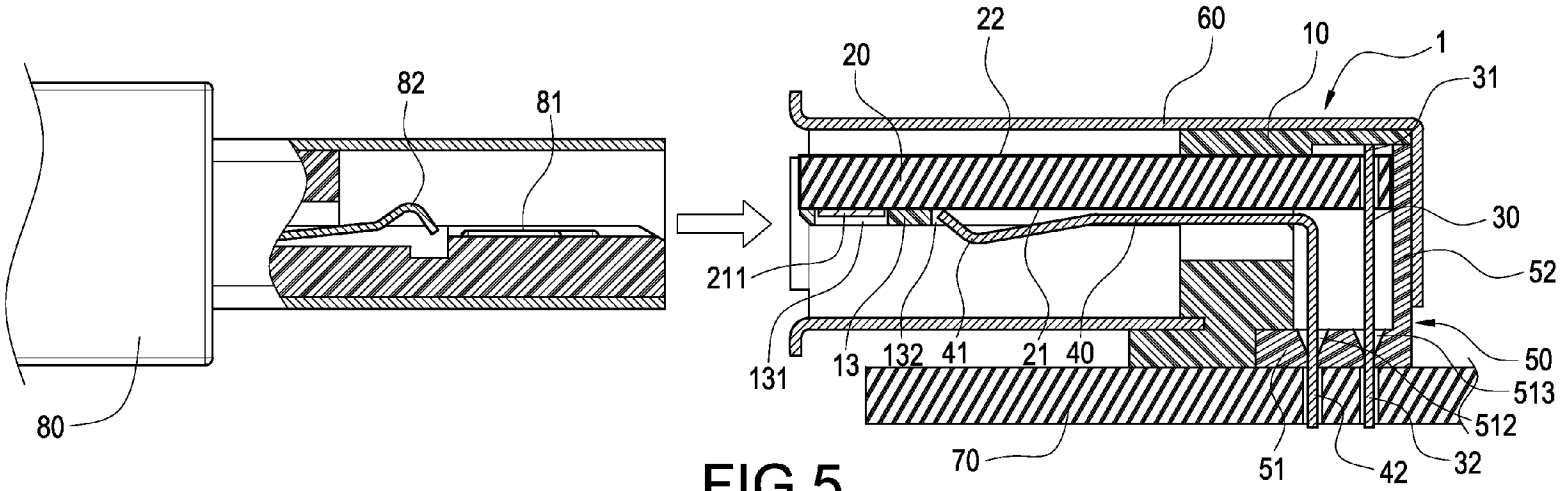
FIG. 5 is a cross-sectional side view of a female connector before being connected to a corresponding male connector in accordance with the present invention.

It is noteworthy to point out that the "front end" mentioned in this specification are defined according to the direction of an opening provided for inserting a male connector 80 (as shown in FIG. 5), and the and the "rear end" refers to the direction opposite to the "front end".

Figure 1:
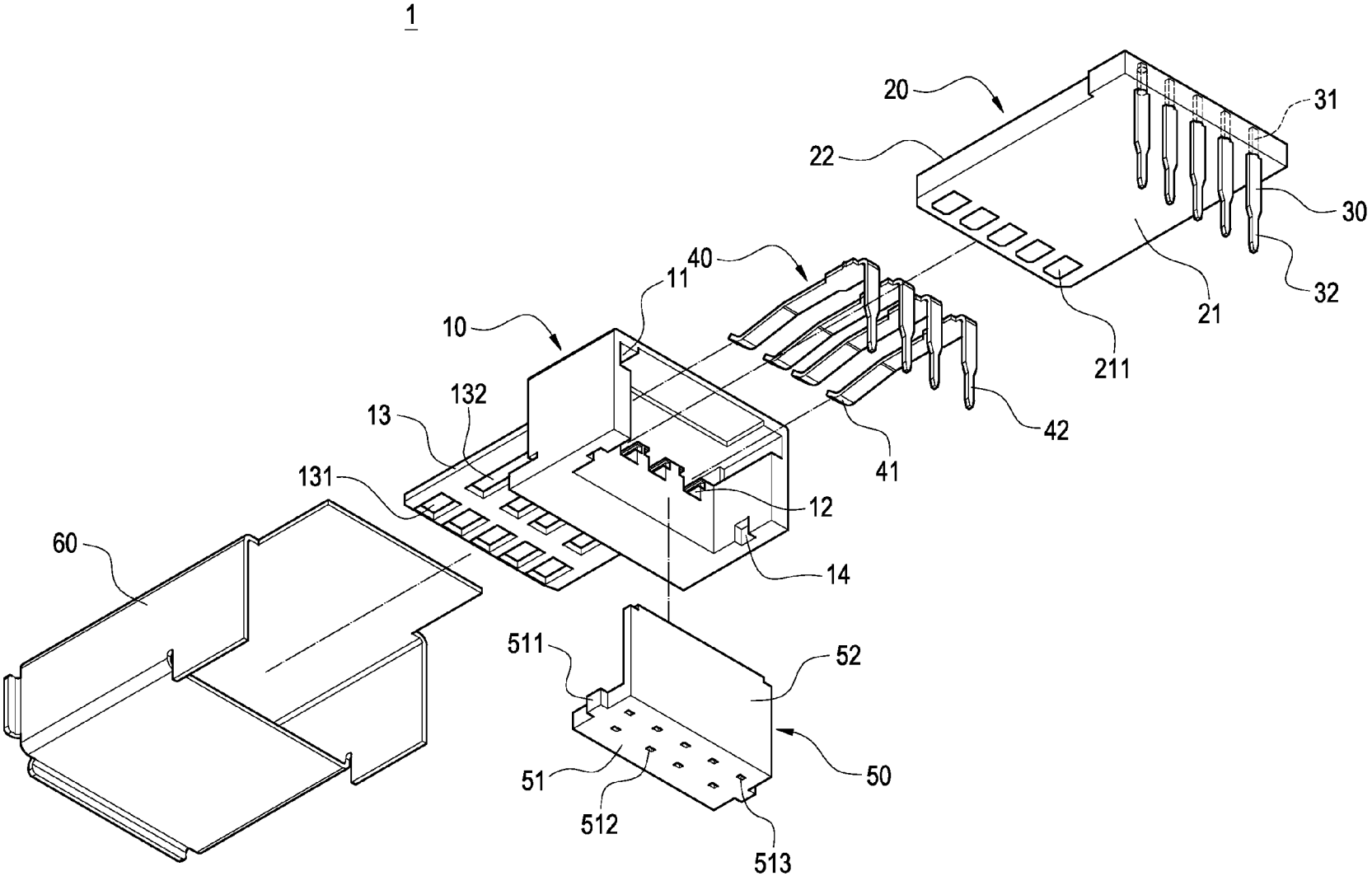
FIG. 1 is an exploded view of the present invention.

With reference to FIG. 1 for an exploded view of the present invention, the present invention provides an improved USB connector structure (hereinafter referred to as "female connector 1"), and this female connector 1 comprises an insulating body 10, a circuit board 20, a plurality of connecting terminals 30, a plurality of conductive terminals 40, a fixed base 50, and a metal casing 60.

The insulating body 10 is made of an insulating material such as plastic or resin, and a through notch 11 is formed in an anteroposterior direction of the insulating body 10, and a plurality of terminal slots 12 is formed at a lower edge of the through notch 11. The through notch 11 and the terminal slot 12 are penetrated through both front and rear ends of the insulating body 10 respectively, and the insulating body 10 has a stop plate 13 extended forwardly from the plurality of terminal slots 12, and a plurality of first openings 131 and a plurality of second openings 132 formed on the stop plate 13. Wherein, the quantity of the plurality of first openings 131 is equal to the quantity of the plurality of connecting terminals 30. In this preferred embodiment, the quantity is equal to five. The quantity of the plurality of terminal slots 12 and the plurality of second openings 132 is equal to the quantity of the plurality of conductive terminals 40. In this preferred embodiment, the quantity is equal four, but the present invention is not limited by such quantity.

It is noteworthy to point out that the plurality of first openings 131 are formed at positions parallel to the front edge of the stop plate 13, and the plurality of second openings 132 are formed at positions parallel to the rear of the plurality of first openings 131 and maintained with a specific interval from the plurality of first openings 131, such that the plurality of first openings 131 and the plurality of second openings 132 will not affect with each other.

The circuit board 20 is a thin printed circuit board having a width substantially equal to the width of the through notch 11 of the insulating body 10, so that the circuit board 20 can be passed and coupled into the through notch 11. The circuit board 20 has a first surface 21 and a second surface 22 disposed opposite to each other. In this preferred embodiment, the first surface 21 refers to the lower surface of the circuit board 20, and the second surface 22 refers to the upper surface of the circuit board 20.

The aforementioned first surface 21 has a plurality of goldfingers 211 installed at a front end of the first surface 21, and the goldfingers 211 are made of a conductive copper foil material and formed on the first surface 21. Wherein, the quantity of the plurality of goldfingers 211 is equal to the quality of the plurality of connecting terminals 30 and the plurality of first openings 131. In this preferred embodiment, the quantity includes but not limited to five. When the circuit board 20 is passed and coupled into the through notch 11 in the insulating body 10, the plurality of goldfingers 211 are exposed from the plurality of first openings 131 formed on the stop plate 13, so that the goldfingers 211 can be physically contacted with the external terminal to define an electric connection.

In this preferred embodiment, five goldfingers 211 and four conductive terminals 40 constitute a universal serial bus (USB) 3.0 connecting structure.

The plurality of connecting terminals 30 are made of a conductive metal material, and each connecting terminal 30 has an end portion 31 disposed at an end of the connecting terminal 30, and a soldering portion 32 disposed on another end away from the end portion 31. The end portion 31 of each connecting terminals 30 is disposed at a rear end of the circuit board 20 and away from the goldfinger 211 and electrically coupled to the goldfinger 211 on the first surface 21, and each soldering portion 32 is extended in a direction opposite to the circuit board 20. The quantity of the connecting terminals 30 is equal to the quantity of the goldfingers 211. In this preferred embodiment, the quantity is equal to five.

The plurality of conductive terminals 40 are made of a conductive metal material, and each conductive terminal 40 is passed and coupled into the terminal slot 12 of the insulating body 10. In this preferred embodiment, the quantity of the plurality of conductive terminals 40 is equal to four. Each conductive terminal 40 has a conducting portion 41 disposed at a front end of the conductive portion 41, and a soldering portion 42 formed at a rear end of each conducting portion 41. When the conductive terminal 40 is passed and coupled into the terminal slot 12 of the insulating body 10, and the conducting portion 41 of each conductive terminal 40 is protruded out from the front end of the insulating body 10, and each conducting portion 41 is protruded from the plurality of second openings 132 on the stop plate 13 and out from the insulating body 10. Therefore, each conducting portion 41 can be physically contacted with the external terminal or goldfinger to produce an electric connection, and further achieve the effect of fixing the plurality of conductive terminals 40 by the stop plate 13, and the soldering portion 42 of each conductive terminal 40 is protruded out from a rear end of the terminal slot 12 and bent downwardly and disposed parallel to the soldering portion 32 of the connecting terminals 30.

Figure 2:
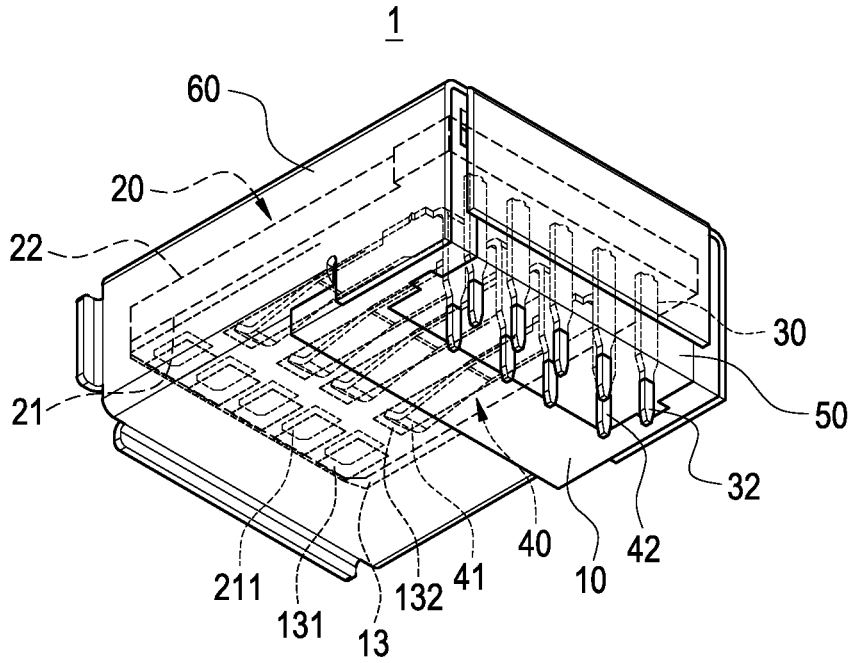
FIG. 2 is a perspective view of a first assembly of the present invention.
Figure 3:
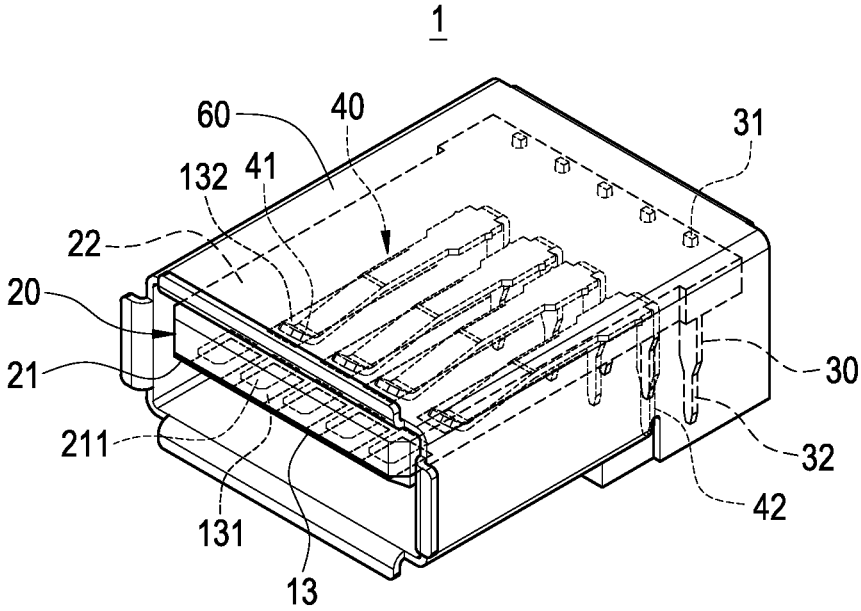
FIG. 3 is a perspective view of a second assembly of the present invention.
Figure 4:
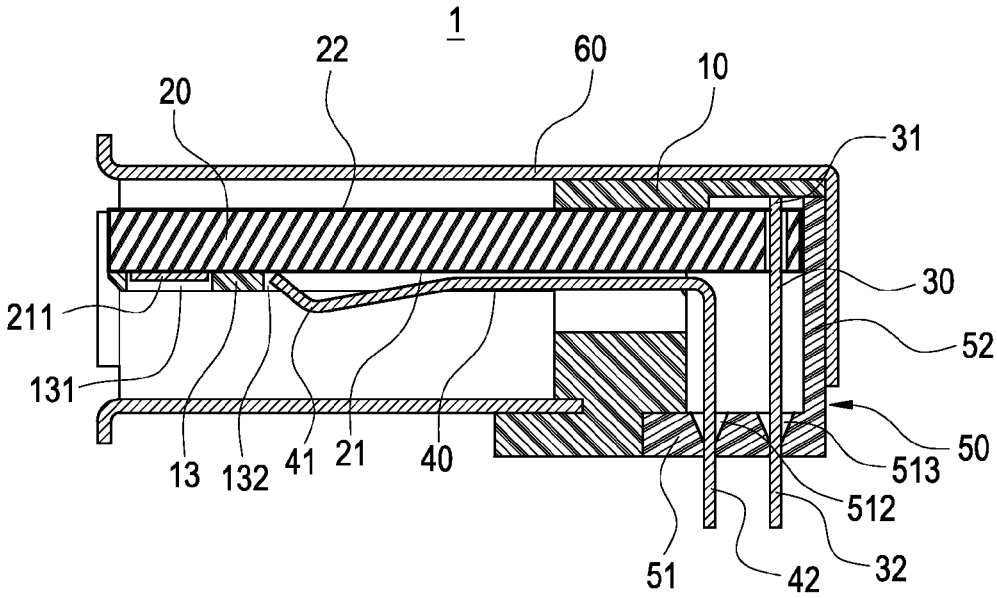
FIG. 4 is a cross-sectional view of the present invention.

With reference to FIGS. 2 and 3 for perspective views of the first and second assemblies of the present invention, the conducting portion 41 of each conductive terminal 40 is disposed at the rear of the goldfinger 211 on the first surface 21. With reference to FIG. 4 for a cross-sectional view of the present invention, the plurality of goldfingers 211 on the first surface 21 of the circuit board 20 are exposed from the plurality of first openings 131 on the stop plate 13, and the conducting portions 41 of plurality of conductive terminals 40 are not attached flatly on the first surface 21, but protruded from the plurality of second openings 132 on the stop plate 13 and out from the insulating body 10. In other words, the conducting portion 41 of each conductive terminal 40 and the goldfinger 211 on the first surface 21 are not situated at the same altitude.

In FIG. 1, the fixed base 50 includes a bottom plate 51, a rear cover plate 52 extended vertically upward from the bottom plate 51, and a protruding pillar 511 disposed on both sides of the bottom plate 51 separately. The bottom plate 51 includes front-row plug holes 512 and back-row plug holes 513 formed thereon, and the quantity of front-row plug holes 512 is equal to four and provided for inserting the soldering portion 42 of the plurality of conductive terminals 40; and the quantity of back-row plug holes 513 is equal to five and provided for inserting the soldering portion 32 of the plurality of connecting terminals 30. Therefore, the front-row plug holes 512 and the back-row plug holes 513 have the quantity and positions corresponding to those of the soldering portions 42 of the plurality of conductive terminals 40 and the soldering portion 32 of the plurality of connecting terminals 30.

In addition, the soldering portions 42 of the plurality of conductive terminals 40 and the soldering portions 32 of the plurality of connecting terminals 30 are extended downwardly to pass through the front-row plug holes 512 and back-row plug holes 513, and finally the soldering portions 42, 32 are electrically soldered to an external circuit substrate 70 (as shown in FIG. 5), so that the female connector 1 of the present invention can be electrically coupled to the external circuit substrate 70.

The insulating body 10 has a snap slot 14 formed on both internal sidewalls of the bottom of the insulating body 10 separately and provided for embedding the protruding pillars 511 on both sides of the bottom plate 51, so that when the fixed base 50 is assembled from bottom up to the bottom of the insulating body 10, the protruding pillar 511 of the bottom plate 51 is snapped into the snap slot 14 at the bottom of the insulating body 10, and the soldering portion 42 of each conductive terminal 40 is passed through the front-row plug hole 512 on the bottom plate 51, and the soldering portion 32 of each connecting terminal 30 is passed through the back-row plug hole 513 on the bottom plate 51. In the meantime, the rear cover plate 52 is covered onto a rear distal surface of the insulating body 10 to protect the circuit board 20, the plurality of connecting terminals 30, and the plurality of conductive terminals 40 in the insulating body 10.

The metal casing 60 is substantially a rectangular hollow casing covered onto the external periphery of the insulating body 10 to provide a metal shielding effect to prevent electromagnetic interference and protect the circuit board 20, the plurality of connecting terminals 30, and the plurality of conductive terminals 40 installed in the metal casing.

Figure 6:
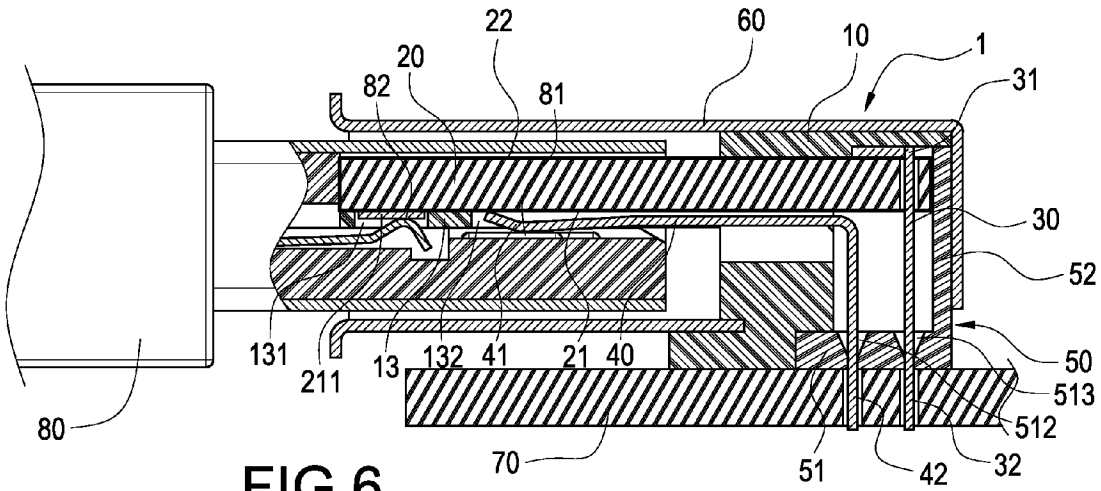
FIG. 6 is a cross-sectional side view of a female connector after being connected to a corresponding male connector in accordance with the present invention.

With reference to FIGS. 5 and 6 for cross-sectional side views of a female connector before and after being connected to a corresponding male connector in accordance with the present invention respectively, the male connector 80 is a male connector in compliance with the USB 3.0 specification having four first terminals 81 and five second terminals 82. From the cross-sectional side view as depicted in FIG. 5, the first terminal 81 is situated below the second terminal 82, and the first terminal 81 and the second terminal 82 are aligned alternately in different front and back rows.

In FIG. 6, when the female connector 1 of the present invention is aligned and connected to a male connector 80, the goldfinger 211 on the first surface 21 of the circuit board 20 will be contact with the second terminal 82 in the male connector 80, and the conducting portion 41 of the conductive terminal 40 will be contacted with the first terminal 81 in the male connector 80, so that the female connector 1 and the male connector 80 can be electrically conducted and connected. It is noteworthy to point out that when the conducting portion 41 of the conductive terminal 40 abuts the first terminal 81 in the male connector 80, each conductive terminal 40 will be pressed to move. Each conductive terminal 40 is passed and coupled into the terminal slot 12 of the insulating body 10, and each conducting portion 41 is protruded from the plurality of second openings 132 of the stop plate 13 and out from the insulating body 10. With the stop plate 13 used for snapping and fixing each conductive terminal 40, each conductive terminal 40 will not be deviated due to the connection with the male connector 80, so as to reduce the failure rate of the connector.

Compared with the prior art, the present invention includes the plurality of goldfingers 211 directly installed at the front end of the circuit board 20 and the plurality of connecting terminals 30 installed at the rear and electrically coupled to the goldfingers 211 to substitute the conventional five conductive terminals, and the insulating body 10 no longer requires the tongue plate to be extended to connect the nine conductive terminals so as to simplify the structure of the female connector 1 and comply with the thin design requirement. On the other hand, the simplified structure of the present invention requires less number of components, so that the manufacturing cost and the assembling time can be reduced. In addition, each conductive terminal 40 is passed and coupled into the terminal slot 12 of the insulating body 10, and each conducting portion 41 has an insulating body 10 formed on the stop plate 13 and protruded out from the plurality of second openings 132, so as to prevent each conductive terminal 40 from being deviated after a long time of use.

While the invention has been described by means of specific embodiments, numerous modifications and variations could be made thereto by those skilled in the art without departing from the scope and spirit of the invention set forth in the claims.

What is claimed is:

1. A universal serial bus (USB) connector structure, comprising:

an insulating body, having a through notch formed therein, a plurality of terminal slots formed at a lower edge of the through notch, a stop plate extended forwardly from the plurality of terminal slots, a plurality of first openings formed at a front edge of the stop plate, and a plurality of second openings formed at the rear of the plurality of first openings;

a circuit board, passed into and coupled to the through notch, and having a first surface and a second surface disposed opposite to each other, a plurality of goldfingers disposed at a front end of the first surface, and each of the goldfingers being exposed from the first opening on the stop plate;

a plurality of connecting terminals, each having an end portion disposed at an end of the connecting terminal, and passed into the circuit board and at a position away from the rear end of the goldfinger, and electrically coupled to the goldfinger; and a plurality of conductive terminals, passed into and coupled to the terminal slots respectively, and each having a conducting portion disposed at a front end of the conductive terminal and disposed at the rear end of the goldfinger, and the conducting portion extending from the second opening on the stop plate and out from the insolating body.

2. The USB connector structure of claim 1, further comprising a metal casing covered onto the external periphery of the insulating body.

3. The USB connector structure of claim 2, wherein the conducting portions and the goldfingers on the first surface are situated at different level heights.

4. The USB connector structure of claim 2, wherein each of the connecting terminals has a first soldering portion disposed at the other end away from the end portion, and the first soldering portion is extended in a direction away from the circuit board, and each of the conductive terminals has a second soldering portion disposed at the other end away from the conducting portion, and the second soldering portion is protruded from the rear end of the terminal slot and bent and extended downwardly to align parallel to the first soldering portion.

5. The USB connector structure of claim 4, further comprising a fixed base coupled to the bottom of the insulating body, and the fixed base having front-row plug holes and back-row plug holes, and the quantity and positions of the front-row plug holes corresponding to the quantity and positions of the conductive terminals, and provided for inserting and coupling the soldering portions of the conductive terminals, and the quantity and positions of back-row plug holes corresponding to the quantity of connecting terminals and provided for inserting and coupling the soldering portions of the connecting terminals.

6. The USB connector structure of claim 4, wherein the first soldering portion and the second soldering portion are soldered and electrically coupled to an external circuit substrate.

7. The USB connector structure of claim 2, wherein the goldfingers on the first surface come with a quantity of five and the connecting terminals come with a quantity of five.

8. The USB connector structure of claim 7, wherein the terminal slots come with a quantity of four.

9. The USB connector structure of claim 8, wherein the conductive terminals come with a quantity of four.

10. The USB connector structure of claim 9, wherein the first openings on the stop plate come with a quantity of five, and the second openings come with the quantity of four.

* * * * *